US009080469B2

(12) United States Patent
Suzuki et al.

(10) Patent No.: US 9,080,469 B2
(45) Date of Patent: Jul. 14, 2015

(54) LASH ADJUSTER

(71) Applicant: OTICS CORPORATION, Nishio-shi, Aichi (JP)

(72) Inventors: Hiroyuki Suzuki, Anjo (JP); Hideki Oka, Handa (JP); Kiyoshi Masegi, Okazaki (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 0 days.

(21) Appl. No.: 14/175,610

(22) Filed: Feb. 7, 2014

(65) Prior Publication Data

US 2014/0224202 A1 Aug. 14, 2014

(30) Foreign Application Priority Data

Feb. 14, 2013 (JP) ..... 2013-026427

(51) Int. Cl.
*F01L 1/18* (2006.01)
*F01L 1/24* (2006.01)
(Continued)

(52) U.S. Cl.
CPC ..... *F01L 1/24* (2013.01); *F01L 1/2405* (2013.01); *F01L 1/255* (2013.01); *F01L 2001/2427* (2013.01); *F01L 2001/256* (2013.01)

(58) Field of Classification Search
CPC ..... F01L 1/241; F01L 1/2405; F01L 1/255; F01L 2001/2427
USPC ..... 123/90.46, 90.52, 90.59, 90.43
See application file for complete search history.

(56) References Cited

U.S. PATENT DOCUMENTS 5,509,385 A 4/1996 LaVieri
5,706,773 A 1/1998 Dura et al.
(Continued)

FOREIGN PATENT DOCUMENTS

DE 2343269 3/1975
DE 19614668 10/1997
(Continued)

OTHER PUBLICATIONS

European Search Report corresponding to co-pending EP application No. 1400213.0 dated Apr. 22, 2014, listed in IDS for U.S. Appl. No. 14/175,560.
(Continued)

*Primary Examiner* — Zelalem Eshete
(74) *Attorney, Agent, or Firm* — Smith, Gambrell & Russell, LLP

(57) ABSTRACT

A lash adjuster includes a plunger having a bottom wall with a valve hole and a peripheral wall having an oil passage hole and an inner periphery formed with a recessed groove, the plunger defining a high-pressure chamber between the bottom wall and a body, and a partitioning member having an oil passage end located above the oil passage hole. The partitioning member has an oil-passage defining portion located opposite the recessed groove and defining an oil passage between itself and a groove face of the recessed groove. The partitioning member defines a low-pressure chamber reserving a hydraulic fluid flowing through the oil passage hole, the oil passage and the oil passage end. The low-pressure chamber causes the reserved hydraulic fluid to flow through the valve hole into the high-pressure chamber. The partitioning member is formed into a cylindrical shape and extends in an up-down direction without any stepped part.

5 Claims, 7 Drawing Sheets

(51) Int. Cl.

| | |
|---|---|
| *F01L 1/255* | (2006.01) |
| *F01L 1/245* | (2006.01) |

(56) References Cited

U.S. PATENT DOCUMENTS

| | | | |
|---|---|---|---|
| 5,979,377 | A | 11/1999 | Barth et al. |
| 2005/0178351 | A1 | 8/2005 | Mayer et al. |
| 2014/0224201 | A1 | 8/2014 | Oka et al. |
| 2014/0230766 | A1 | 8/2014 | Fujii et al. |
| 2014/0230767 | A1 | 8/2014 | Yamamoto et al. |
| 2014/0230768 | A1 | 8/2014 | Haga et al. |

FOREIGN PATENT DOCUMENTS

| | | |
|---|---|---|
| DE | 10 2005 025 765 | 12/2006 |
| DE | 10 2006 007 375 | 8/2007 |
| DE | 10 2006 007 376 | 8/2007 |
| DE | 10 2006 004 751 | 9/2007 |
| DE | 102006017442 | 10/2007 |
| EP | 1564383 | 8/2005 |
| JP | 57181908 | 11/1982 |
| JP | 61118509 | 6/1986 |
| JP | 06-37504 | 5/1994 |
| JP | 05-288019 | 11/2003 |
| JP | 2004-197665 | 7/2004 |
| JP | 2008-064020 | 3/2008 |
| WO | 9215776 | 9/1992 |

OTHER PUBLICATIONS

May 2014 generated European Search Report for EP Application No. 14000223, listed in IDS for U.S. Appl. No. 14/175,641.

May 15, 2014 generated European Search Report for EP Application No. 14000227, listed in IDS for U.S. Appl. No. 14/175,653.

European Search Report corresponding to co-pending EP application No. 14000199.1 dated Apr. 22, 2014, listed in IDS for U.S. Appl. No. 14/175,670.

European Search Report corresponding to co-pending EP application No. 14 000 198.3 dated Apr. 14, 2014.

Abstract of WO2007/118820 published Oct. 25, 2007.

LASH ADJUSTER

CROSS-REFERENCE TO RELATED APPLICATIONS

This application is based upon and claims the benefit of priority from the prior Japanese Patent Application No. 2013-26427 filed on Feb. 14, 2013, the entire contents of which are incorporated herein by reference.

BACKGROUND

1. Technical Field

The present invention relates to a lash adjuster.

2. Related Art

A conventional lash adjuster includes a bottomed cylindrical body fixed to a cylinder head of an internal combustion engine and a plunger which is inserted into the body so that the plunger is movable up and down. The plunger has an upper end supporting a rocker arm. The plunger further has a peripheral wall formed with an oil passage hole and a bottom wall formed with a valve hole. Hydraulic fluid, such as oil, supplied through an oil filler hole of the cylinder head is stored in a low-pressure chamber in the plunger through the oil passage hole and also supplied through the valve hole into the body thereby to fill the body. A high-pressure chamber is defined by dividing an interior of the body by the bottom wall of the plunger. The plunger is moved up and down according to oil pressure in the high-pressure chamber. The hydraulic fluid in the low-pressure chamber in the plunger is drawn through the valve hole into the high-pressure chamber when the plunger is moved upward. In this case, there is a possibility that air entrainment may occur in the high-pressure chamber when the hydraulic fluid level is low in the low-pressure chamber.

In view of the aforementioned problem, the conventional art provides a lash adjuster provided with a cylindrical partitioning member inserted into the plunger. A space inside the partitioning member serves as a low-pressure chamber. An oil passage is formed between an inner periphery of the plunger and an outer periphery of the partitioning member. An oil passage end is located above the oil passage hole. As a result, a large amount of hydraulic fluid is supplied from the oil passage hole via the oil passage and the oil passage end into the low-pressure chamber. Since the hydraulic fluid level depends upon the oil passage end located above the oil passage hole, air entrainment can be prevented in the high-pressure chamber. The partitioning member includes a lower part having a press-fit part press-fitted with an inner periphery of the lower peripheral wall of the plunger and an upper part having an annular recess which has a small diameter and defines an oil passage between itself and an inner periphery of the upper peripheral wall of the plunger. The partitioning member further has a squeezed portion which is located between the annular recess and the press-fit part and whose diameter is gradually reduced from the press-fit part toward the annular recess.

When a vertical dimension of the oil passage is increased in the above-described conventional lash adjuster, a vertical dimension of the press-fit part is rendered smaller in inverse proportion to the vertical dimension of the oil passage. This reduces a press-fit allowance of the press-fit part particularly in small-sized lash adjusters, resulting in a problem that the partitioning member is difficult to fix in a stable state in the plunger.

SUMMARY

Therefore, an object of the invention is to provide a lash adjuster in which the partitioning member can be fixed in a stable state in the plunger.

The invention provides a lash adjuster including a body formed into a bottomed cylindrical shape, a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body, the peripheral wall having an inner periphery formed with a recessed groove, a partitioning member inserted into the plunger to be fixed therein and formed into a tubular shape. In the lash adjuster, the partitioning member has an oil passage end located above the oil passage hole in state where the partitioning member is inserted in the plunger. The partitioning member has an oil-passage defining portion which is located opposite the recessed groove and defines an oil passage between itself and a groove face of the recessed groove. The partitioning member defines thereinside a low-pressure chamber, the low-pressure chamber reserving a hydraulic fluid flowing thereinto through the oil passage hole, the oil passage and the oil passage end, the low-pressure chamber causing the hydraulic fluid reserved therein to flow through the valve hole into the high-pressure chamber. The partitioning member is formed into a cylindrical shape and extends in an up-down direction without any stepped part.

The oil passage can be provided in the recessed groove of the plunger. This does not require any special structure to provide the oil passage in the partitioning member, with the result that the design flexibility of the partitioning member can be improved. Accordingly, for example, an insertion region for the partitioning member can be set in the plunger without any difficulty. The partitioning member can stably be fixed in the plunger. The above-mentioned form of the partitioning member requires no especially complicated machining and can accordingly reduce the manufacturing man-hour and the manufacturing cost. Furthermore, the inner capacity of the low-pressure chamber located inside the partitioning member can be increased, with the result that the above-described construction is suitably applicable to small-sized lash adjusters.

In another embodiment, the partitioning member is formed with a press-fit part which is press-fitted with an inner periphery of the peripheral wall of the plunger in a state where the partitioning member is inserted in the plunger. Consequently, the partitioning member can easily be assembled in the plunger.

In further another embodiment, a forming region of the press-fit part covers a region above the oil passage hole in the state where the partitioning member is inserted in the plunger. Consequently, since the press-fit-portion forming region is enlarged as compared with the conventional construction, the partitioning member can be fixed in plunger further stably.

In further another embodiment, the press-fit part is press-fitted with the entire inner periphery of a part of the peripheral wall of the plunger located below the oil passage hole in the state where the partitioning member is inserted in the plunger. This construction can prevent the oil passage and the high-pressure chamber from direct communication.

In further another embodiment, the press-fit part is formed on the entire outer periphery of the partitioning member except for the oil-passage defining portion. Consequently, the partitioning member can be fixed in the plunger further stably and a forming region of the oil passage defined between the recessed groove and the oil-passage defining portion can be formed with economy.

DETAILED DESCRIPTION

Figure 1:
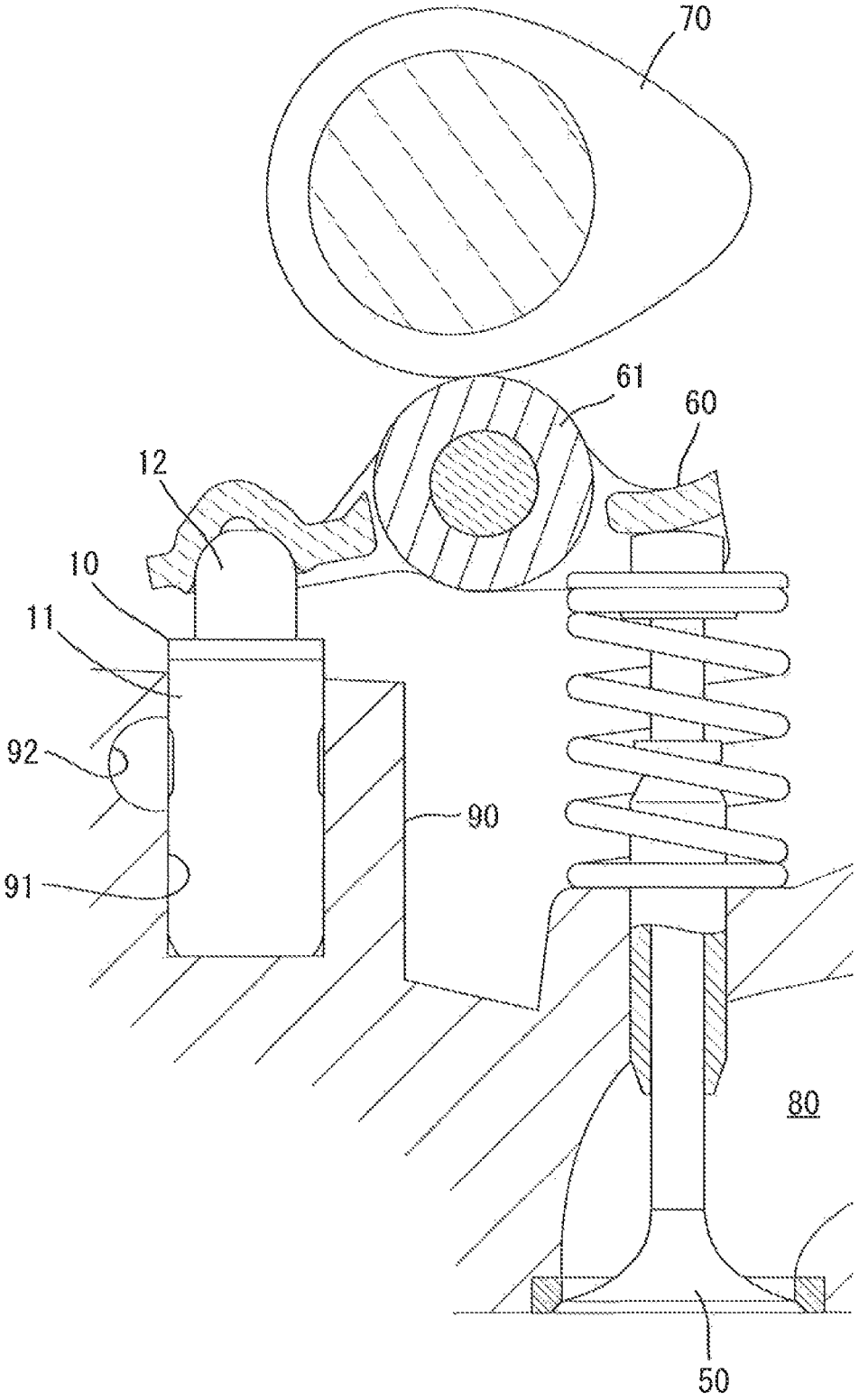
FIG. 1 is a schematic sectional view of an internal combustion engine in which a lash adjuster in accordance with one embodiment is incorporated.

Embodiment 1 of the present invention will be described with reference to FIGS. 1 to 5 of the accompanying drawings. Referring to FIG. 1, a lash adjuster 10 in accordance with embodiment 1 is shown. As shown, the lash adjuster 10 is incorporated in a valve gear of an internal combustion engine. The valve gear includes a valve 50, a rocker arm 60 and a cam 70 in addition to the lash adjuster 10.

The lash adjuster 10 is inserted into a mounting recess 91 of a cylinder head 90 from above. The valve 50 is provided to be capable of opening and closing an intake/exhaust port 80 of the cylinder head 90. The rocker arm 60 is disposed so as to extend between an upper end (a support portion 25 of a plunger 12 as will be described later) of the lash adjuster 10 and an upper end of the valve 50 in a right-left direction. The cam 70 is disposed above the rocker arm 60 so as to be slidable together with a roller 61 of the rocker arm 60. Upon rotation of the cam 70, the rocker arm 60 is swung in an up-down direction with the upper end of the lash adjuster 10 serving as a fulcrum. With swing of the rocker arm 60, the valve 50 is moved up and down thereby to open and close the intake/exhaust port 80.

Figure 2:
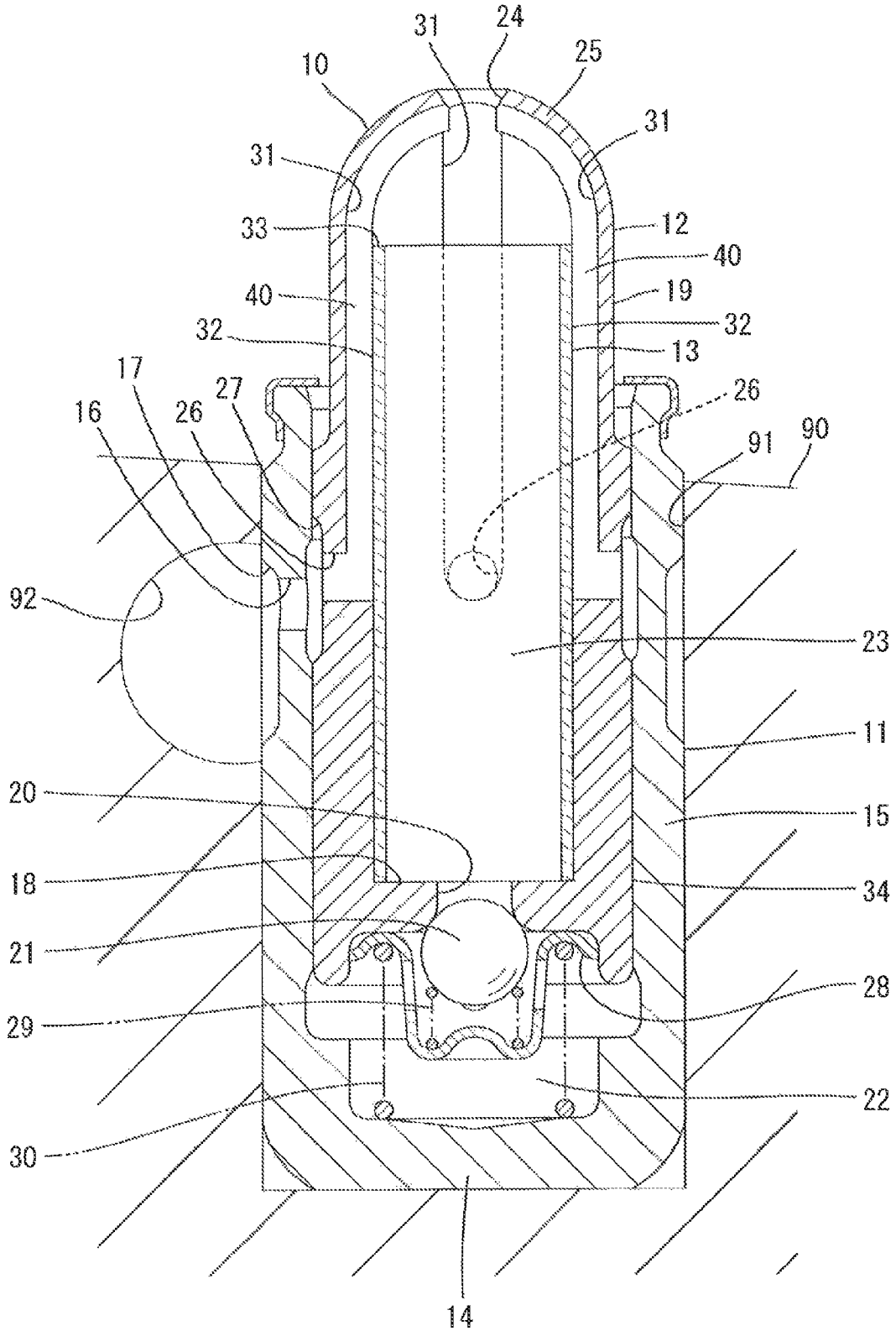
FIG. 2 is a sectional view of the lash adjuster.

The lash adjuster 10 will now be described more concretely. The lash adjuster 10 includes a body 11, a plunger 12 and a partitioning member 13 as shown in FIG. 2. The body 11 has a disc-shaped bottom wall 14 and a cylindrical peripheral wall 15 standing from an outer periphery of the bottom wall 14. The body 11 is formed into a bottomed cylindrical shape as a whole. The body 11 is fittable into the mounting recess 91 of the cylinder head 90. The peripheral wall 15 of the body 11 has an outer oil passage hole 16 formed therethrough. The outer oil passage hole 16 is disposed in communication with an oil filler hole 92 of the cylinder head 90. Furthermore, the body 11 has an outer periphery formed with an annular recess 17 which extends over the entire periphery thereof and in which the outer oil passage hole 16 is open. Accordingly, the outer oil passage hole 16 and the oil filler hole 92 are retained in communication via the annular recess 17 even when the body 11 is rotated in the mounting recess 91.

The plunger 12 has a disc-shaped bottom wall 18 and a cylindrical peripheral wall 19 standing from an outer periphery of the bottom wall 18 and is formed into a bottomed cylindrical shape as a whole. The bottom wall 13 includes a central part through which a valve hole 20 is formed. The valve hole 20 communicates between a high-pressure chamber 22 and a low-pressure chamber 23 via a valve element 21 as will be described later. The peripheral wall 19 has an upper end formed with a semispherical support portion 25 which is radially squeezed and has a centrally located through hole 24. The support portion 25 includes an outer semispherical surface on which a rocker arm 60 is adapted to slide during swinging.

Figure 5:
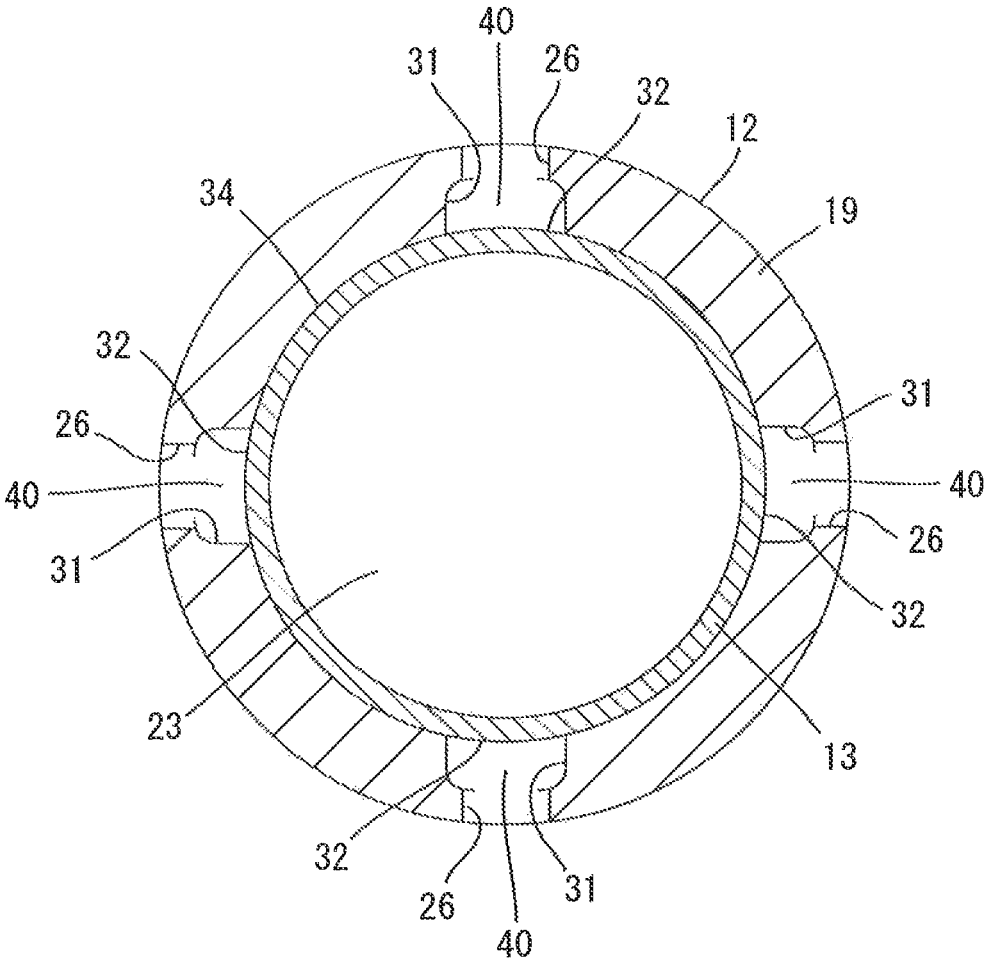
FIG. 5 is a sectional view taken along line A-A in FIG. 3.

The peripheral wall 19 also has a plurality of oil passage holes 26 formed through an outer periphery thereof. The oil passage holes 25 are arranged circumferentially at regular intervals and four oil passage holes 26 are formed circumferentially at intervals of 90° in embodiment 1 as shown in FIG. 5. The outer periphery of the peripheral wall 19 further has an annular recess 27 which extends over the whole periphery thereof and in which the oil passage holes 26 are open, as shown in FIG. 2. The oil passage holes 26 communicate with the outer of passage holes 16 of the body 11 via the annular recess 27, and the oil passage holes 26 and the outer oil passage holes 16 are retained in communication even when the plunger 12 is rotated in the body 11, respectively.

Figure 4:
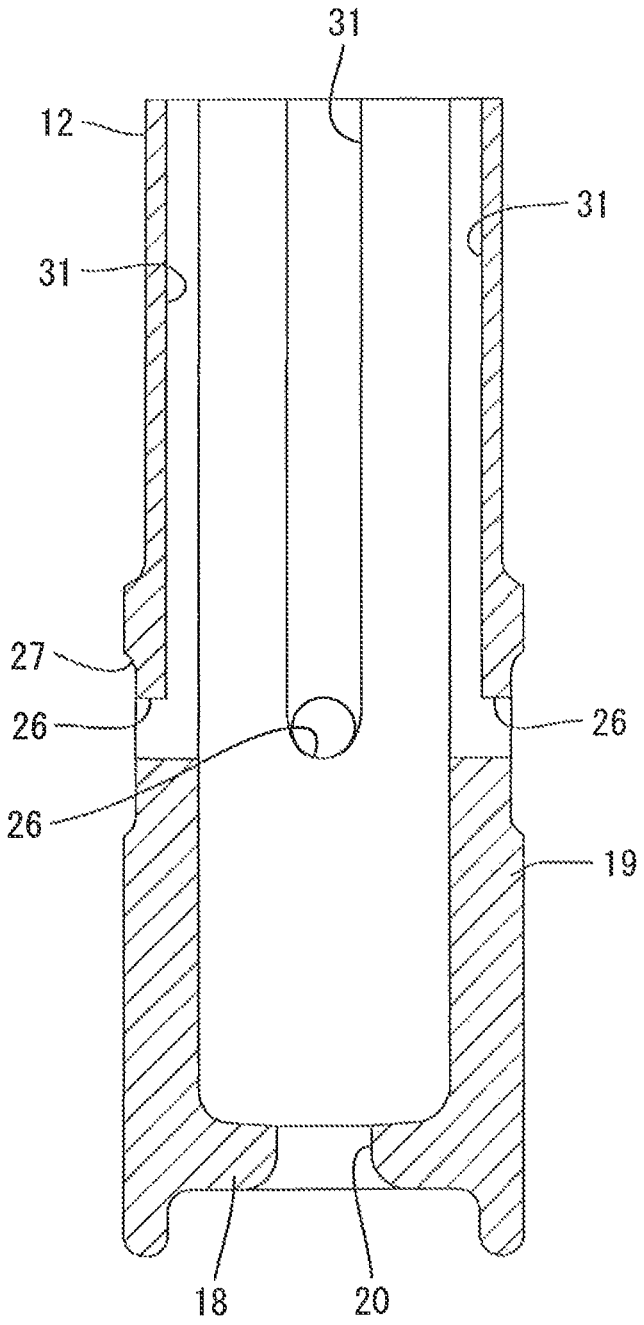
FIG. 4 is a sectional view of the plunger before the forming of a support portion.

On the other hand, the peripheral wall 19 has an inner periphery formed with a plurality of recessed grooves 31. The recessed grooves 31 are disposed so as to radially communicate with the oil passage holes 26 respectively and extend upward from the same height position as the respective oil passage holes 26 to be open to the through hole 24. More specifically, each recessed groove 31 has a substantially rectangular section such that each recessed groove 31 has a circumferentially slightly larger groove width than each oil passage hole 26 as shown in FIG. 5. The recessed grooves 31 depthwise intersect and communicate with the respective oil passage holes 26 at a substantially central part in the thickness direction of the peripheral wall 19. Each recessed groove 31 extends in the up-down direction with the uniform width and the uniform depth in embodiment 1 as shown in FIG. 4.

The high-pressure chamber 22 is defined between the bottom wall 18 of the plunger 12 and the body 11 when the plunger 12 is inserted into the body 11, as shown in FIG. 2. A spherical valve element 21 is provided in the high-pressure chamber 22. The valve element 21 is housed in a cage-like retainer 28 and biased by a first spring 29 in a direction such that the valve hole 20 is closed. The high-pressure chamber 22 is also provided with a second spring 30 located between the bottom wall 14 of the body 11 and an upper edge of the retainer 28. The plunger 12 is biased upward by the second spring 30.

Figure 3:
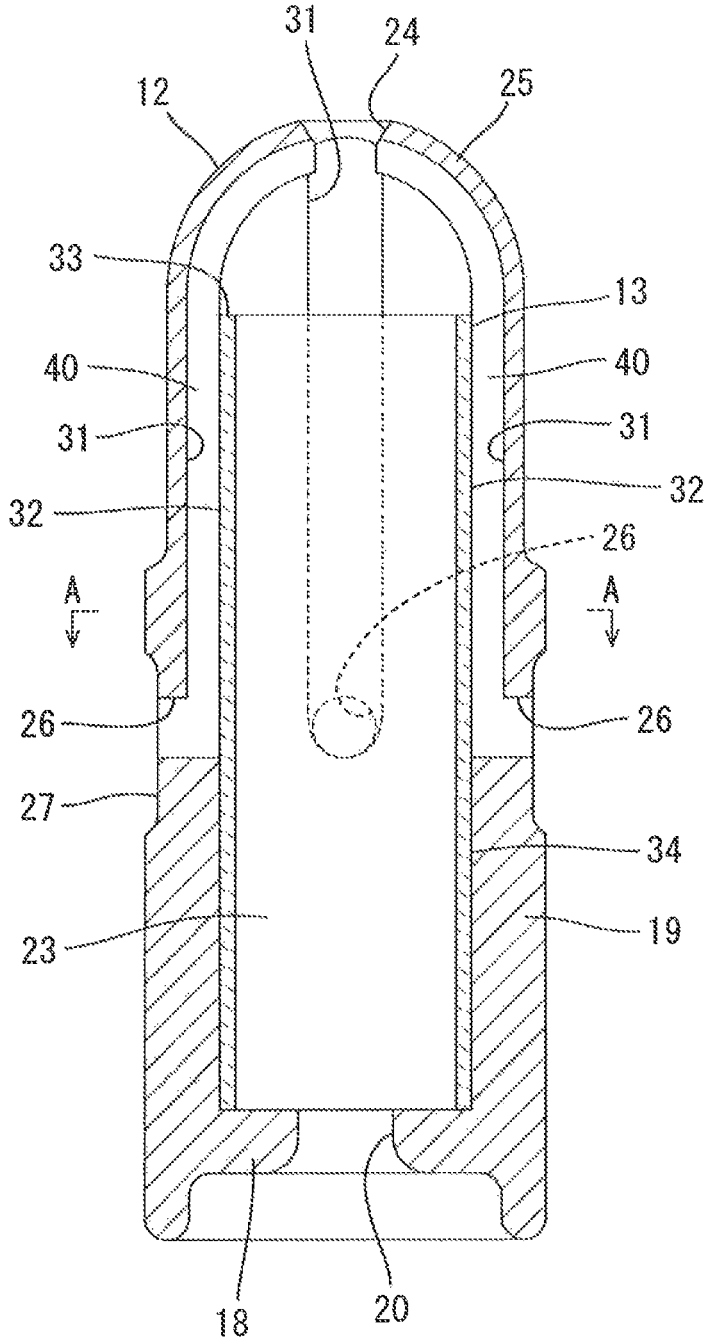
FIG. 3 is a sectional view of the plunger in which the partitioning member is inserted.

The partitioning member 13 is inserted into the plunger 12 to be fixed in position as shown in FIGS. 2 and 3. The partitioning member 13 is a tubular body made of a metal and is formed into a cylindrical shape extending in an up-down direction. In a state where the partitioning member is inserted in the plunger 12, a lower end of the partitioning member 13 is in abutment with the bottom wall 18 of the plunger 12 and an upper end of the partitioning member 13 is located at a position near the support portion 25 of the plunger 12, at which position the upper end of the partitioning member 13 is located above the oil passage holes 28.

More specifically, the partitioning member 13 extends in an up-down direction with a uniform diameter has a circular section which is uniform over an entire height thereof. The partitioning member 13 has no stepped portion in the up-down direction. The partitioning member 13 has an outer periphery including portions opposed to the respective recessed grooves 31 in a state where the partitioning member 13 is inserted in the plunger 12. These opposed parts serve as oil-passage defining portions 32. The outer periphery of the partitioning member 13 is configured so that the oil-passage defining portions 32 and the other part of the outer periphery are continuous without any stepped portions. When the partitioning member 13 is inserted into the plunger 12, the oil-passage defining portions 32 close inner openings of the recessed grooves 31, whereby oil passages 40 are defined between the groove faces of the recessed grooves 31 and the oil-passage defining portions 32, respectively. The oil passages 40 defined as described above face an upper end of the partitioning member 13, which end serves as an oil passage end 33. Furthermore, a low-pressure chamber 23 is defined inside the partitioning member 13 in the plunger 12.

An entire part of the outer periphery of the partitioning member 13 except for the oil-passage defining portion 32 is configured as a press-fit part 34. In a state where the partitioning member 13 is inserted in the plunger 12, the press-fit part 34 is abuttable on an inner periphery of the peripheral wall 19 in a press-fit state. In other words, the press-fit part 34 is press-fitted with an entire inner periphery of a part of the peripheral wall 19 of the plunger 12 located below the oil passage holes 26 in the state where the partitioning member 13 is inserted in the plunger 12. The press-fit part 34 is further provided over an entire part of the partitioning member 13 except for the oil-passage defining portions 32 located above the oil passage holes 26.

The partitioning member 13 is inserted into the plunger 12 in a press-fitted state via the press-fit part 34 from an upper end opening of the plunger 12 which has not been formed with the support portion 25 (see FIG. 4). After the partitioning member 13 has been inserted into the plunger 12, an upper end of the plunger 12 is squeezed in a diameter-reducing direction, so that the support portion 25 is formed together with a through hole 24.

The hydraulic fluid flowing through the oil filler hole 92 of the cylinder head 90 is supplied sequentially through the outer oil passage holes 16, the oil passage holes 26, the oil passages 40 and the oil passage end 33 to be reserved in the low-pressure chamber 23. The hydraulic fluid reserved in the low-pressure chamber 23 is further supplied through the valve hole 20 to fill the high-pressure chamber 22. In this case, since the oil passage end 33 of the partitioning member 13 is located above the oil passage hole 26, the hydraulic fluid is reserved in the low-pressure chamber 23 to a level above the oil passage holes 26.

The valve element 21 closes the valve hole 20 thereby to close the high-pressure chamber 22 when a downward pressure is applied from the rocker arm 60 side to the plunger 12 in the state where the hydraulic fluid has been introduced into the low-pressure chamber 23 and the high-pressure chamber 22. As a result, the plunger 12 is stopped lowering by the hydraulic pressure of the high-pressure chamber 22. On the other hand, when the plunger 12 is raised with decrease in the pressure from the rocker arm 60 side, the capacity of the high-pressure chamber 22 is increased. When the capacity of the high-pressure chamber 22 is increased, the valve element 21 is lowered thereby to open the valve hole 20. As a result, the hydraulic fluid in the low-pressure chamber 23 flows through the valve hole 20 into the high-pressure chamber 22 thereby to fill the high-pressure chamber 22. Upon stop of the upward movement of the plunger 12, the valve element 21 is biased by the first spring 29 thereby to be moved upward and close the valve hole 20, so that the high-pressure chamber 22 is closed. Thus, the plunger 12 is moved up and down relative to the body 11, whereby the support position of the plunger 12 relative to the rocker arm 60 fluctuates with the result that a valve clearance is adjusted.

Since the oil passages 40 are provided in the respective recessed grooves 31 of the plunger 12 in embodiment 1, no special structure is provided for the provision of the oil passages 40 in the partitioning member 13. Accordingly, the press-fit part 34 can be provided in a broader region of the partitioning member 13 without depending upon the oil passages 40, so that the partitioning member 13 can be fixed in the plunger 12 stably. In particular, since a forming region of the press-fit part 34 covers the region located above the oil passage holes 26 in the state where the partitioning member 13 is inserted in the plunger 12, the partitioning member 13 can be fixed in the plunger 12 further stably.

Furthermore, the partitioning member 13 is formed into a cylindrical shape and extends in the up-down direction without any stepped portions and machined without requiring special processing. Accordingly, the number of man-hour of the partitioning member 13 can be reduced and the manufacturing costs can be suppressed. Furthermore, the upper side of the partitioning member 13 is not recessed so as to be smaller in diameter than the lower side of the partitioning member 13. This can ensure a larger inner capacity of the low-pressure chamber 23 defined inside the partitioning member 13, and this construction is particularly applicable to small-sized lash adjusters more suitably.

Embodiment 2

Figure 6:
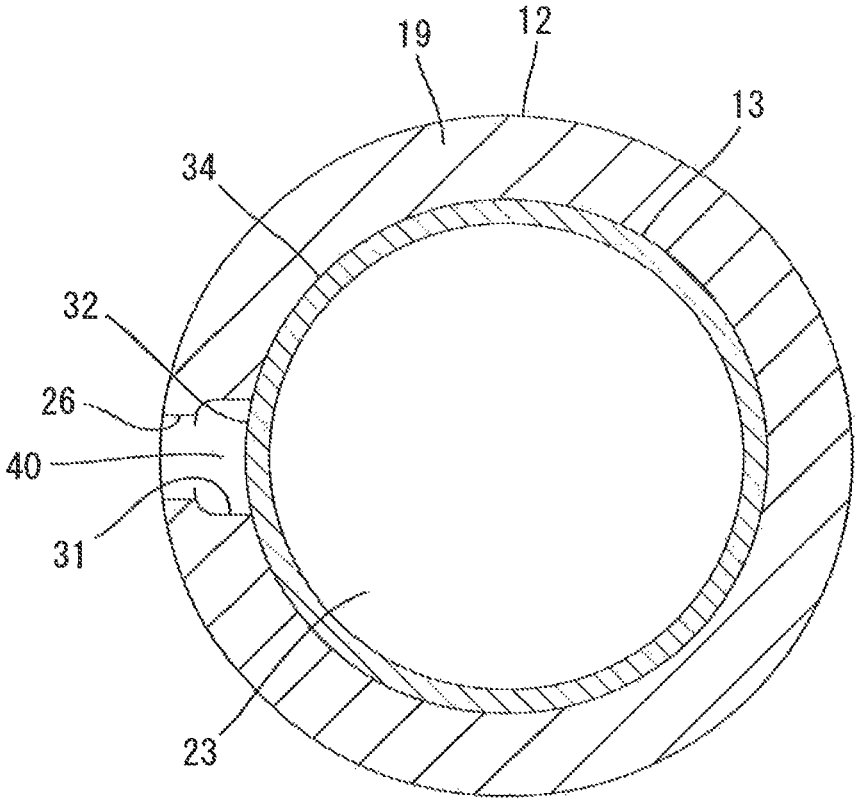
FIG. 6 is a view similar to FIG. 5, showing the lash adjuster in accordance with embodiment 2.

FIG. 6 illustrates embodiment 2 of the invention.

In embodiment 2, the peripheral wall 19 of the plunger 12 is formed with a single oil passage hole 26, and the inner periphery of the peripheral wall 19 is formed with a single recessed groove 31. A single oil passage 40 is defined between the groove face of the recessed groove 31 and the oil-passage defining portion 32 of the partitioning member 13. The recessed groove 31 and the oil passage 40 in embodiment 2 are similar to those in embodiment 1. That is, the recessed groove 31 and the oil passage 40 extend in the up-down direction and have respective lower ends communicating with the oil passage hole 26 and respective upper ends open to the through hole 24. The structure of the lash adjuster including the partitioning member 13 other than the above-described is similar to that in embodiment 1. Since the oil passage hole 26, the recessed groove 31 and the like in embodiment 2 have similar shapes to those in embodiment 1, the same reference symbols as those in embodiment 1 are used in embodiment 2.

Embodiment 3

Figure 7:
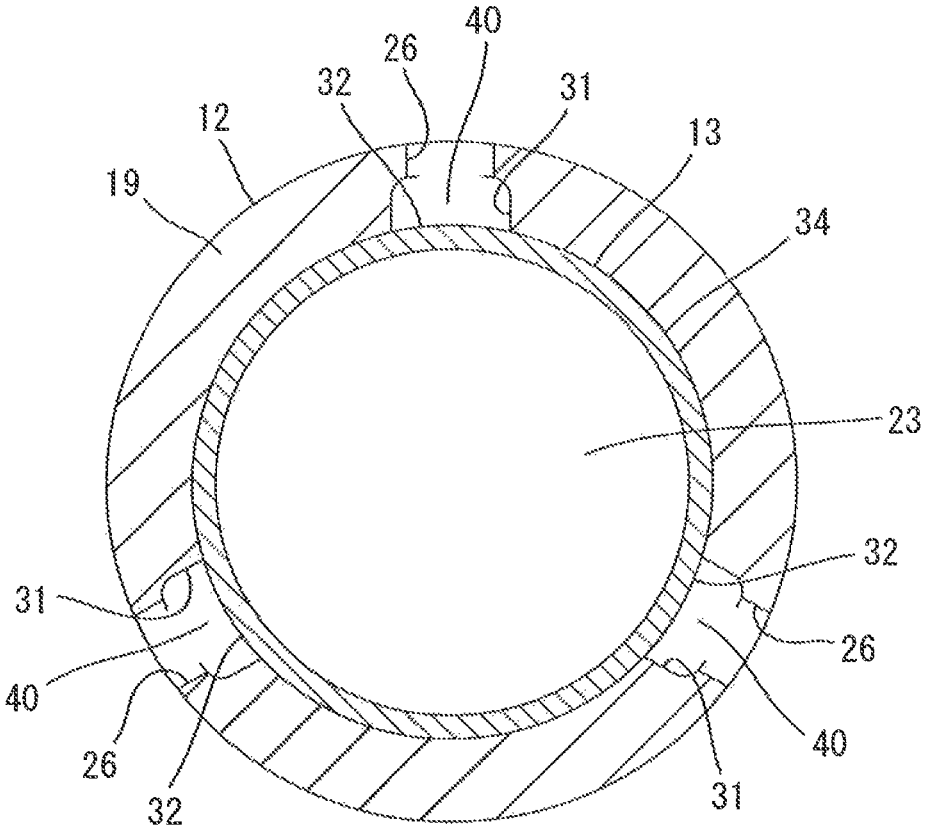
FIG. 7 is a view similar to FIG. 5, showing the lash adjuster in accordance with embodiment 3.

FIG. 7 illustrates embodiment 3.

In embodiment 3, three oil passage holes 26 are formed through the peripheral wall 19 of the plunger 12 circumferentially at intervals of 120°. Three recessed grooves 31 are formed in the inner periphery of the peripheral wall 19 circumferentially at intervals of 120°. The oil passage holes 26 and the recessed grooves 31 radially communicate with one another respectively. Furthermore, in the state where the partitioning member 3 is inserted in the plunger 12, three oil passages 40 are defined between the groove face of the recessed grooves 31 and the oil-passage defining portion 32. Embodiment 3 is similar to embodiment 1 in the other construction, and accordingly, identical or similar parts in embodiment 3 are labeled by the same reference symbols as those in embodiment 1.

The invention should not be limited to the foregoing embodiments and the following embodiments are included in the technical scope of the invention.

(1) The recessed groove and the oil passage may only be configured to extend in the up-down direction at least from the oil passage hole toward the oil passage end as a whole. The recessed groove and the oil passage may be slightly inclined in the vertical direction.

(2) The lower end of the partitioning member may depart from the bottom wall of the plunger without abutment on the bottom wall of the plunger.

(3) The partitioning member may not have a uniform radius over the entire height. For example, an upper end of the partitioning member may be squeezed along an inner semi-spherical face of the support portion in the diameter-reducing direction.

(4) The oil passage end may be recessed in the upper end of the partitioning member into a cutout shape.

(5) The press-fit part may be press fitted in the plunger by shrink fitting.

What is claimed is:

1. A lash adjuster comprising:

a body formed into a bottomed cylindrical shape;

a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body, the peripheral wall having an inner periphery formed with a recessed groove;

a partitioning member inserted into the plunger to be fixed therein and formed into a tubular shape, wherein:

the partitioning member has an oil passage end located above the oil passage hole in a state where the partitioning member is inserted in the plunger;

the partitioning member has an oil-passage defining portion which is located opposite the recessed groove and defines an oil passage between itself and a groove face of the recessed groove;

the partitioning member defines there inside a low-pressure chamber, the low-pressure chamber reserving a hydraulic fluid flowing thereinto through the oil passage hole, the oil passage and the oil passage end, the low-pressure chamber causing the hydraulic fluid reserved therein to flow through the valve hole into the high-pressure chamber; and the partitioning member is formed into a cylindrical shape and extends in an up-down direction without any stepped part.

2. The lash adjuster according to claim 1, wherein the partitioning member is formed with a press-fit part which is press-fitted with an inner periphery of the peripheral wall of the plunger in a state where the partitioning member is inserted in the plunger.

3. The lash adjuster according to claim 2, wherein a forming region of the press-fit part covers a region above the oil passage hole in the state where the partitioning member is inserted in the plunger.

4. The lash adjuster according to claim 2, wherein the press-fit part is press-fitted with the entire inner periphery of a part of the peripheral wall of the plunger located below the oil passage hole in the state where the partitioning member is inserted in the plunger.

5. The lash adjuster according to claim 2, wherein the press-fit part is formed on the entire outer periphery of the partitioning member except for the oil-passage defining portion.

* * * * *